United States Patent [19]

Borinelli et al.

[11] Patent Number: 4,463,857

[45] Date of Patent: Aug. 7, 1984

[54] LIFTING AND SWIVELLING DEVICE

[75] Inventors: Enrico Borinelli, Eggenwil; Karl Bühler, Nussbaumen, both of Switzerland

[73] Assignee: BBC Brown, Boveri & Company, Limited, Baden, Switzerland

[21] Appl. No.: 81,129

[22] Filed: Oct. 2, 1979

[51] Int. Cl.[3] ..... C10B 25/14

[52] U.S. Cl. ..... 212/166; 414/669; 187/8.49

[58] Field of Search ..... 212/166; 414/665, 669, 414/684.5; 164/335; 266/265, 267, 249; 110/176–178; 187/8.49, 8.5, 8.47

[56] References Cited

U.S. PATENT DOCUMENTS

| | | | |
|---|---|---|---|
| 1,976,996 | 10/1934 | Jones | 187/849 |
| 3,268,918 | 8/1966 | Batty et al. | 414/669 |
| 3,753,502 | 8/1973 | Abendroth | 212/166 |
| 3,966,060 | 6/1976 | Andrews et al. | 212/166 |

FOREIGN PATENT DOCUMENTS

| | | | |
|---|---|---|---|
| 530526 | 6/1939 | United Kingdom | 187/849 |

*Primary Examiner*—John J. Love
*Assistant Examiner*—L. E. Williams
*Attorney, Agent, or Firm*—Burns, Doane, Swecker and Mathis

[57] ABSTRACT

A method and apparatus for lifting and swivelling a cover of a furnace away from a cauldron of the furnace is disclosed. The apparatus includes a longitudinally moveable and rotatable column housed in a cylinder. A bar, having a longitudinal axis which is substantially parallel to a longitudinal axis of the column, is spaced apart from, and connected to, the column. A plate with an aperture is connected to an upper end of the cylinder. The bar may move through the aperture in the plate when the longitudinal axis of the bar is aligned with a center of the plate. A double-acting hydraulic cylinder is mounted on the plate. The cylinder includes a piston rod which is connected to a pivot head. The pivot head encircles the bar.

8 Claims, 3 Drawing Figures

LIFTING AND SWIVELLING DEVICE

BACKGROUND AND SUMMARY OF THE PRESENT INVENTION

The invention disclosed herein pertains to a lifting and swivelling device for a cover of a furnace, and more particularly to a lifting and swivelling device for a cover of an arc furnace.

During the charging of a furnace all parts of the furnace located above a cauldron of the furnace, including a cover and a superstructure of the furnace, are temporarily moved to one side of the cauldron. After having been moved aside there is a danger that the cover and the superstructure may be unintentionally lowered.

Accordingly, a primary object of the present invention is to provide a method and apparatus for moving a cover and a superstructure of a furnace away from a cauldron of the furnace, while preventing an unintentional lowering of the cover and the superstructure after they have been moved away from the cauldron of the furnace.

Apparatus according to the present invention for moving a cover and a superstructure of a furnace away from a cauldron of the furnace includes a rotatable column arranged adjacent the cauldron of the furnace. The rotatable column is used to lift the superstructure of the furnace above the cauldron, and is used to swivel the superstructure and the cover away from the cauldron.

The lifting of the superstructure is accomplished hydraulically. That is, in a first embodiment of the present invention the rotatable column is itself a piston of an hydraulic cylinder. In a second embodiment a separate hydraulic apparatus for exerting an upward lifting force against a bottom of the rotatable column is arranged beneath the column.

The column may be rotated in one of two ways. That is, in a third embodiment of the present invention, a first toothed segment engages a second toothed segment connected to the column. In a fourth embodiment of the present invention, which is a preferred embodiment, a first end of a double-acting hydraulic cylinder is connected to a stationary stand of a swivelling apparatus, while a second end of the double-acting hydraulic cylinder is connected, at a tangent, to the rotatable column by a lever.

In the preferred embodiment of apparatus, according to the present invention, the apparatus for lifting the superstructure and cover of a furnace and for swivelling the cover, which apparatus includes a column, rests firmly on a foundation of the furnace. The superstructure of the furnace tilts with the cauldron of the furnace during pouring and slagging off operations. Thus the lifting and swivelling apparatus must be capable of being coupled to the superstructure of the furnace during a lifting and swivelling operation, and of being disengaged from the superstructure during a tilting operation such as a pouring or slagging off operation. To accomplish these functions the preferred embodiment of apparatus includes a rotatable column having a conically shaped upper end, which conically shaped upper end may be inserted into a corresponding conically shaped receiving aperture or bore in the superstructure.

The preferred embodiment of apparatus, according to the present invention, is advantageous because the conical shapes of the upper end of the rotatable column and of the corresponding receiving bore in the superstructure ensure that the rotatable column will move safely into the receiving bore, even if there is some slight eccentricity in the shape of the bore or the shape of the upper end of the column.

The preferred embodiment of the present invention also includes a cylinder within which the rotatable column moves, and guides which are connected to an interior of the cylinder and which ensure that the column moves only in a vertical direction. In addition, the preferred embodiment also includes a bar, which may be cylindrical in shape, which bar is spaced apart from, but rigidly connected to, the column. A swivelling apparatus engages the bar to thereby rotate the column. Further, a plate having an aperture through which the bar may pass is rigidly connected to the cylinder. The aperture in the plate is arranged so that when the column is moved vertically upward or downward the bar may pass through the aperture, but after the bar is moved by the swivelling device to rotate the column the bar is out of alignment with the aperture and is thus prevented from moving in the vertical direction. Consequently, the column is prevented from moving in the vertical direction.

The preferred embodiment is also advantageous because the cylindrical bar in combination with the apertured plate greatly reduces the possibility that a superstructure and cover of a furnace which have been raised and swung away from a cauldron might be inadvertently lowered. Thus the stability of the superstructure is enhanced and the possibility of jamming the column's guides is reduced.

In the preferred embodiment the bar, rather than the column, is connected to, and engaged by, the swivelling apparatus. The bar need not be an additional element to the present invention because a driving pin of the swivelling apparatus, which swivelling apparatus is, in any event, needed to rotate the column, may be used as the bar. A length of the driving pin need only be extended by a length of an upstroke of the rotatable column.

The swivelling apparatus used to engage the cylindrical bar, in the preferred embodiment of the present invention, includes a swivelling cylinder. In addition, the swivelling apparatus is mounted on the apertured plate which is connected to the cylinder. Thus, no additional parts are needed to support the swivelling apparatus.

The preferred embodiment of the present invention further includes a stop which substantially confines a motion of the swivelling apparatus to a horizontal plane and largely prevents the swivelling apparatus from undergoing a vertical motion. That is, the stop confines a motion of the swivelling apparatus to a plane which is substantially perpendicular to a longitudinal axis of the column. This is an advantageous feature of the preferred embodiment because without the stop the swivelling apparatus might be frictionally carried along by the bar in a vertical direction during a vertical movement of the bar, resulting in the swivelling apparatus assuming an inclined position. Such an inclined position could cause an undesired rotation of the rotatable column and of the superstructure of the furnace.

In the preferred embodiment of the present invention the cylindrical bar includes a support piece connected to a bottom end of the bar, which support piece has a horizontal cross-section larger than that of the bar. This support piece aids in maintaining the swivelling apparatus in a proper position during a swivelling movement. The support piece also aids in maintaining the swivelling device in a proper position after the cover and the superstructure of a furnace have been swung away from a cauldron of the furnace. Further, because a horizontal cross-section of the support piece is greater than a horizontal cross-section of the bar, the bar is protected from mechanical damage during its movement through the aperture in the apertured plate connected to the cylinder. In addition, the surface of the bar remains smooth and a mutual movement of the bar and of a pivot head of the swivelling apparatus is thus facilitated.

The preferred embodiment of the present invention further includes one or more guide plates which are arranged beneath the apertured plate connected to the cylinder. Each of these plates is arranged so as to be tangent to a point on an outer perimeter of the aperture in the apertured plate. These guide plates are advantageous because they guide the support piece connected to the lower end of the cylindrical bar when the bar is beneath the apertured plate so that the smooth surface of the bar does not touch the wall of the apertured plate and thus is not damaged.

BRIEF DESCRIPTION OF THE DRAWINGS

A preferred embodiment of the present invention is described with reference to the accompanying drawings wherein like members bear like reference numerals, and wherein.

DETAILED DESCRIPTION OF THE PREFERRED EMBODIMENT

Figure 1:
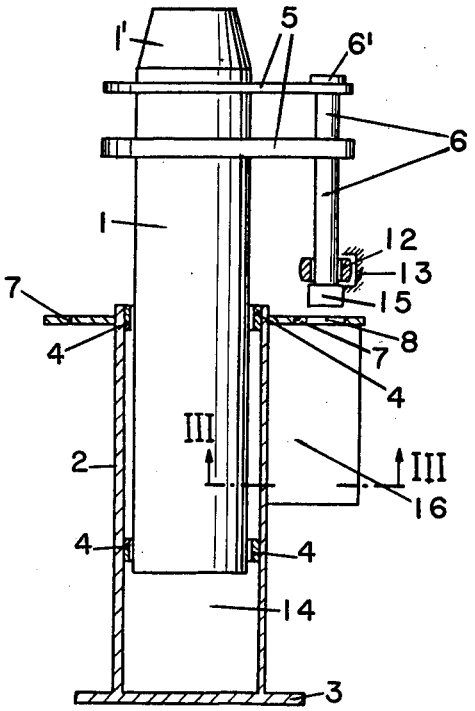
FIG. 1 is a front view, partially in cross-section, of the preferred embodiment of apparatus, according to the present invention, for lifting and swivelling a cover of a furnace.

With reference to FIG. 1, apparatus for lifting and swivelling a cover of a furnace away from a cauldron of a furnace includes a rotatable column 1 having a frusto-conically shaped end 1'. The column 1 is housed within a cylinder 2, which cylinder is connected to a base plate 3. The column 1 is arranged within the cylinder 2 so that a longitudinal axis of the column 1 is substantially parallel to a longitudinal axis of the cylinder 2. The cylinder 2 includes one or more guides 4 connected to an interior of the cylinder to guide the column 1. The guides 4 encircle the column 1 and ensure that a motion of the column 1 will be substantially parallel to the longitudinal axis of the cylinder 2 and thus substantially parallel to the longitudinal axis of the column 1. That is, the guides 4 ensure that the column 1 will be substantially prevented from undergoing lateral motions within the cylinder 2. The cylinder 2 also includes a space 14, in the lower portion of the cylinder, which space is intended for an apparatus for lifting the column 1.

A bar 6, which bar includes a head 6', is connected to the column 1 by means of two mounting plates 5. Connected to a lower end of the bar 6 is a support piece 15, which support piece has a horizontal cross-sectional area which is larger than that of the bar 6. That is, a cross-sectional surface of the support piece 15, which surface is substantially perpendicular to the longitudinal axis of the column 1, has a larger area than a cross-sectional surface of the bar which is substantially perpendicular to the longitudinal axis of the column 1. The bar 6 is arranged so that a longitudinal axis of the bar 6 is substantially parallel to the longitudinal axis of the column 1.

A plate 7 having a bore or aperture 8 is connected to an upper end of the cylinder 2. The plate 7 is arranged so as to be substantially in a plane perpendicular to the longitudinal axis of the cylinder 2. Because the bore 8 is larger than the support piece 15, the bar 6 can pass through the bore 8 when the longitudinal axis of the bar 6 is aligned with the center of the bore 8.

Figure 2:
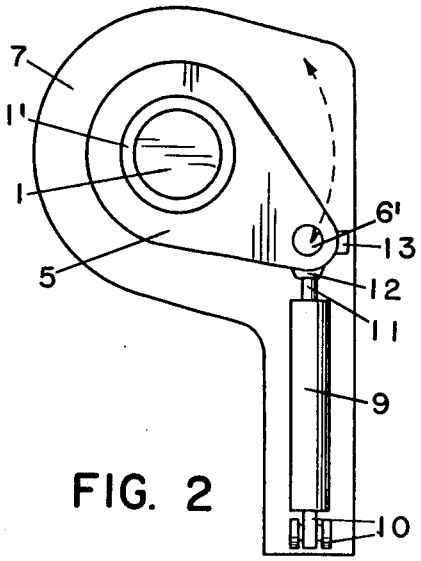
FIG. 2 is a top view of the apparatus shown in FIG. 1.

With reference to FIG. 2, an apparatus for revolving the bar 6 so as to rotate the column 1 includes a double-acting, hydraulic, swivelling cylinder 9, which cylinder is connected to the plate 7 by means of a support 10. The cylinder 9 houses a piston rod 11, which piston rod includes a pivot head 12. The pivot head 12 of the piston rod 11 encircles or encompasses the bar 6. There is some play between the pivot head 12 and the bar 6.

A stop 13, which encompasses a portion of the pivot head 12, prevents the pivot head from undergoing a vertical movement. That is, the stop 13 confines a motion of the pivot head to a plane substantially perpendicular to the longtudinal axis of the column 1.

Figure 3:
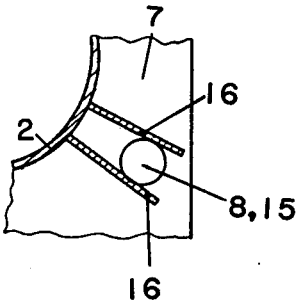
FIG. 3 is a cross-section taken on the line III—III in FIG. 1.

With reference to FIG. 3, as well as FIG. 1, two guide plates 16 are arranged in substantially vertical planes beneath the plate 7 and are arranged radially with respect to the cylinder 2. The surfaces of the guide plates 16 are tangent to the bore 8 so that they can serve as guides for the support piece 15 during a vertical motion of the bar 6.

The apparatus described above is used to lift and swing a cover of a furnace as follows. Initially, a lifting device arranged within the space 14 near the bottom of the cylinder 2 lifts the column 1 in the vertical direction until the frusto-conical head 1' of the column 1 enters a corresponding receiving bore in a superstructure of the furnace. The lifting device continues to lift the column 1 and the superstructure now engaged by the column 1 until the superstructure has been lifted above a cauldron of the furnace. As the column 1 moves vertically upward, the bar 6 will pass through the aperture 8 in the plate 7 until the bar 6 has moved from an initial position beneath the plate 7 to a final position above the plate 7.

Once the bar 6 has moved into a final position above the plate 7, the piston rod 11 is extended from the cylinder 9. The resulting motion of the bar 6, which bar is engaged by the pivot head 12 of the piston rod 11, is represented by an arc-shaped arrow in FIG. 2. That is, the bar 6 revolves in an arc-shaped path about the longitudinal axis of the column 1. The motion of the bar 6 results in the rotation of the column 1, which produces a swinging of the cover of the furnace away from the cauldron of the furnace.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. In a lifting and swivelling device of a cover of an arc furnace, the device having a lifting and revolving column rotatably supported in a guide arrangement, said column being movable vertically and being provided with a swivelling mechanism arranged tangentially, the improvement comprising:

a downwardly pointing bar mounted to the revolving column with an axis parallel to that of the revolving column; and a fixed plate connected to the guide arrangement of the revolving column, said fixed plate extending at least in the swivelling area of the bar and having, at the position of the location of the bar in the working position of the furnace, a bore through which the bar passes.

2. The device according to claim 1, wherein the bar is connected to the swivelling mechanism.

3. The device according to claim 2, wherein the swivelling mechanism includes a swivelling cylinder.

4. The device according to claim 2, wherein the swivelling mechanism is arranged on the fixed plate.

5. The device according to claim 1, further comprising a stop for securing the position of a drive mechanism of the column in the vertical direction.

6. The device according to claim 1, wherein the bottom end of the bar is provided with a support piece having a horizontal cross-section greater than that of the bar.

7. The device according to claim 6, wherein at least one guide element, arranged radially with respect to the cylinder, is mounted below the fixed plate for guiding the support piece.

8. The device according to claim 7, wherein two guide plates are provided for guiding the support piece.

* * * * *